United States Patent [19]

Ng

[11] Patent Number: 5,014,093

[45] Date of Patent: May 7, 1991

[54] COLOR COPYING APPARATUS AND METHOD WITH IMPROVED PRODUCTIVITY

[75] Inventor: Yee S. Ng, Fairport, N.Y.

[73] Assignee: Eastman Kodak Company, Rochester, N.Y.

[21] Appl. No.: 527,454

[22] Filed: May 23, 1990

[51] Int. Cl.[5] ..... G03G 15/01

[52] U.S. Cl. ..... 355/326; 355/77; 430/42; 358/75

[58] Field of Search ..... 355/326, 327, 328, 208, 355/245, 77, 311; 430/31, 42, 44; 358/75, 80

[56] References Cited

U.S. PATENT DOCUMENTS

| | | | |
|---|---|---|---|
| 4,642,681 | 2/1987 | Ikeda | 358/75 X |
| 4,655,579 | 4/1987 | Adachi et al. . | |
| 4,711,553 | 12/1987 | Watanabe . | |
| 4,739,377 | 4/1988 | Allen . | |
| 4,777,510 | 10/1988 | Russel . | |
| 4,803,516 | 2/1988 | Watanabe et al. | 355/326 X |
| 4,970,562 | 11/1990 | Birnbaum et al. | 355/327 |

*Primary Examiner*—R. L. Moses
*Attorney, Agent, or Firm*—Norman Rushefsky

[57] ABSTRACT

Apparatus and method are described for copying with high productivity a mixed batch of originals containing for example process color originals accent color originals and/or single color originals such as black. A scanner scans the originals for color content and ascertains the number of image frames required to reproduce the original. Imaging is then only made on the number of image frames required for reproduction of that original. Scanning is performed with a relatively low resolution scanner. Thus, a "process" black original, made by the combination of three color toners, may be identified as black only even if the colors thereon are not perfectly registered. Such a black only original is reproduced using only one image frame and developed with black only toner thereby providing high productivity and improved quality over the original. The apparatus and method of the invention are preferably achieved using electrophotographic reproduction techniques.

20 Claims, 5 Drawing Sheets

COLOR COPYING APPARATUS AND METHOD WITH IMPROVED PRODUCTIVITY

BACKGROUND OF THE INVENTION

1. Field of the Invention

The present invention relates primarily to electrophotographic reproduction apparatus and methods and, more specifically, to improvements in reproduction of documents some of which have more than one color.

2. Brief Description of the Prior Art

In the prior art as described in U.S. Pat. No. 4,655,579 an electrophotographic reproduction apparatus is described for reproducing an original document of one or more colors. As the original document is optically scanned onto each of four image frames a sensor senses the color content of the original and erases areas of image frames that are not to be developed. For example, a black only original will ordinarily be imageable upon each of the image frames that are to be developed with cyan, magenta, yellow and black toner. However, in response to the signals from the sensor the image frames to be developed with cyan, magenta and yellow are all erased of charge prior to development so that development of the image is provided only on the image frame developed in black. While this produces a true black reproduction, rather than a "process" black reproduction, i.e., a reproduction of black using superimposed cyan, magenta, and yellow toners, the reproduction process is slow as it requires four separate scannings of an original.

It is therefore an object of the invention to provide method and apparatus for improved productivity of reproducing originals, some of which have color content.

SUMMARY OF THE INVENTION

This and other objects are accomplished by apparatus for making copy comprising:

an electrophotographic recording member;

means for electrostatically charging said recording member;

means for supporting a document sheet for exposure;

means for directing an optical image of the image on the document sheet upon the recording member to imagewise modulate the electrostatic charge;

means for sensing the color content of the image on the document sheet for distinguishing between a colored original image and black only original image on the document sheet and generating a signal in accordance with such distinguishing means for developing electrostatic images with differently colored toners including a black only toner;

means responsive to said signal for controlling the number of exposures of said document sheet upon said recording member wherein when said signal indicates a colored original a plural number of exposures are made and when said signal indicates a black only original fewer exposures than said number are made;

means responsive to said signal for developing electrostatic images of colored originals with differently colored toners and for developing an electrostatic image of a black only original with black toner; and means for transferring one or more developed images to a copy sheet.

The invention is further accomplished by a method for making copy comprising:

electrostatically charging an electrophotographic recording member;

modulating the electrostatic charge by optically projecting an image of a document sheet to be reproduced upon the recording member;

automatically sensing the color content of the image to be reproduced and generating a signal identifying the document as a black only original;

in response to said signal inhibiting the development of the member with colored toners; and developing an exposed image frame of said member with a black only toner and transferring the developed image to a copy sheet.

BRIEF DESCRIPTION OF THE DRAWINGS

The subsequent description of the preferred embodiment of the present invention refers to the attached drawings wherein.

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1:
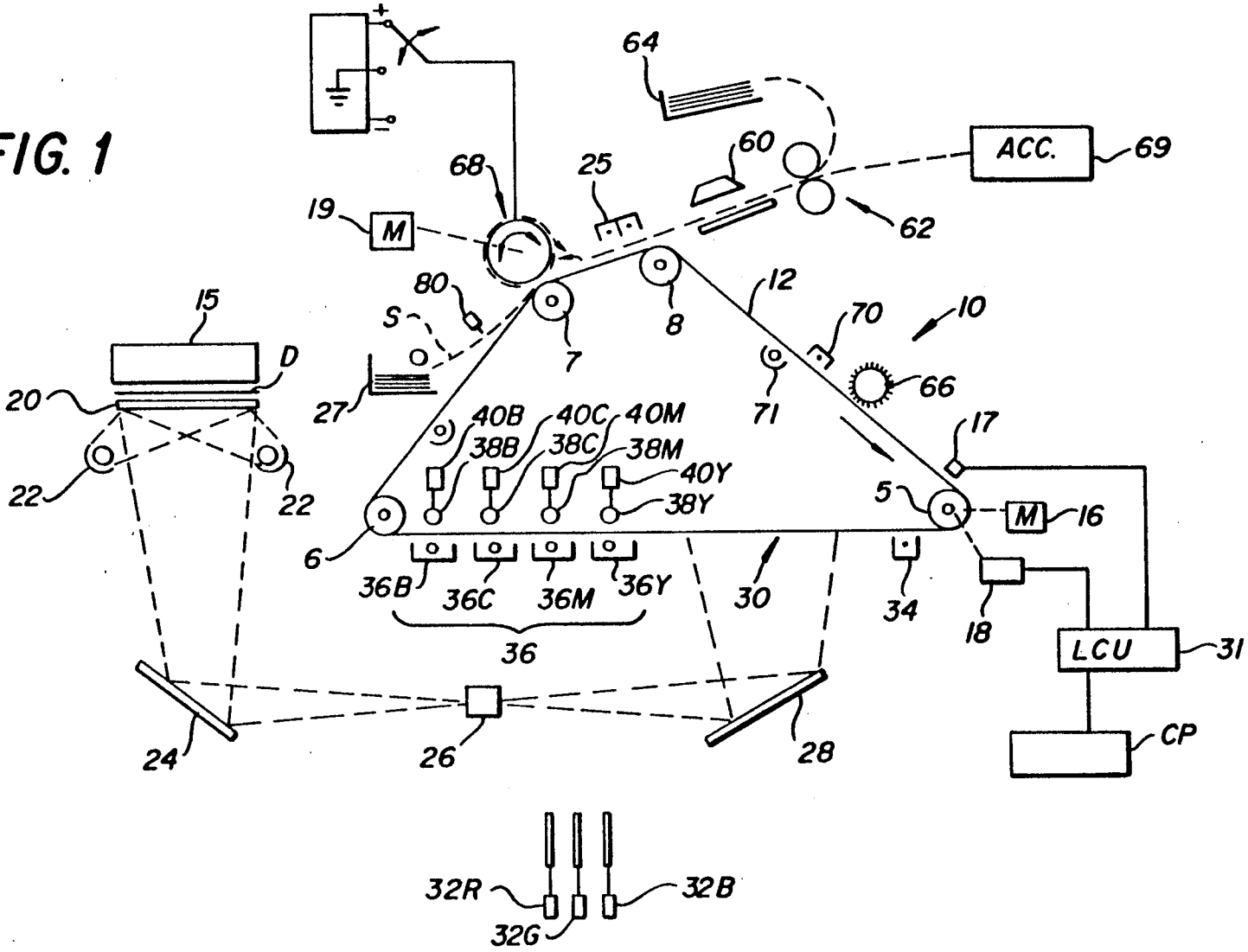
FIG. 1 is a schematic side view of the operating elements of a multicolor electrophotographic reproduction apparatus for practice of the present invention.

With reference now to FIG. 1, a four color multicolor electrophotographic reproduction apparatus is shown.

The apparatus 10 includes a closed loop, flexible image transfer member, or photoconductive web 12. The web 12 is supported on rollers 5–8. The rollers are mounted on the copier frame (not shown) with one of the rollers, for example roller 5, rotatively driven by a motor 16 to effect continuous movement of the web 12 in a clockwise direction about its closed loop path. The web has a plurality of sequentially spaced, non-overlapping image areas which pass successively through electrophotographic processing stations (charge, expose, develop, transfer, clean) located about the path of the web. The web also includes timing marks (or regularly spaced perforations) which are sensed by appropriate means, such as timing signal generator 17 to produce timing singals. Such signals are sent to a computer controlled logic and control unit 31. The LCU 31 controls the entire electrophotographic process based on the instantaneous location of the web in the travel path. An encoder 18 associated with the roller drive motor 16 also produces timing signals for the LCU. The signals from the encoder cause the LCU to fine tune the process timing. The LCU 31 has a digital computer, preferably a microprocessor. The microprocessor has a stored program responsive to the input signals for sequentially actuating, then de-actuating the work stations as well as for controlling the operation of many other machine functions.

Programming of a number of commercially available microprocessors is a conventional skill well understood in the art. This disclosure is written to enable a programmer having ordinary skill in the art to produce an appropriate control program for the microprocessor. The particular details of any such program would, of course, depend on the architecture of the designated microprocessor.

Figure 4:
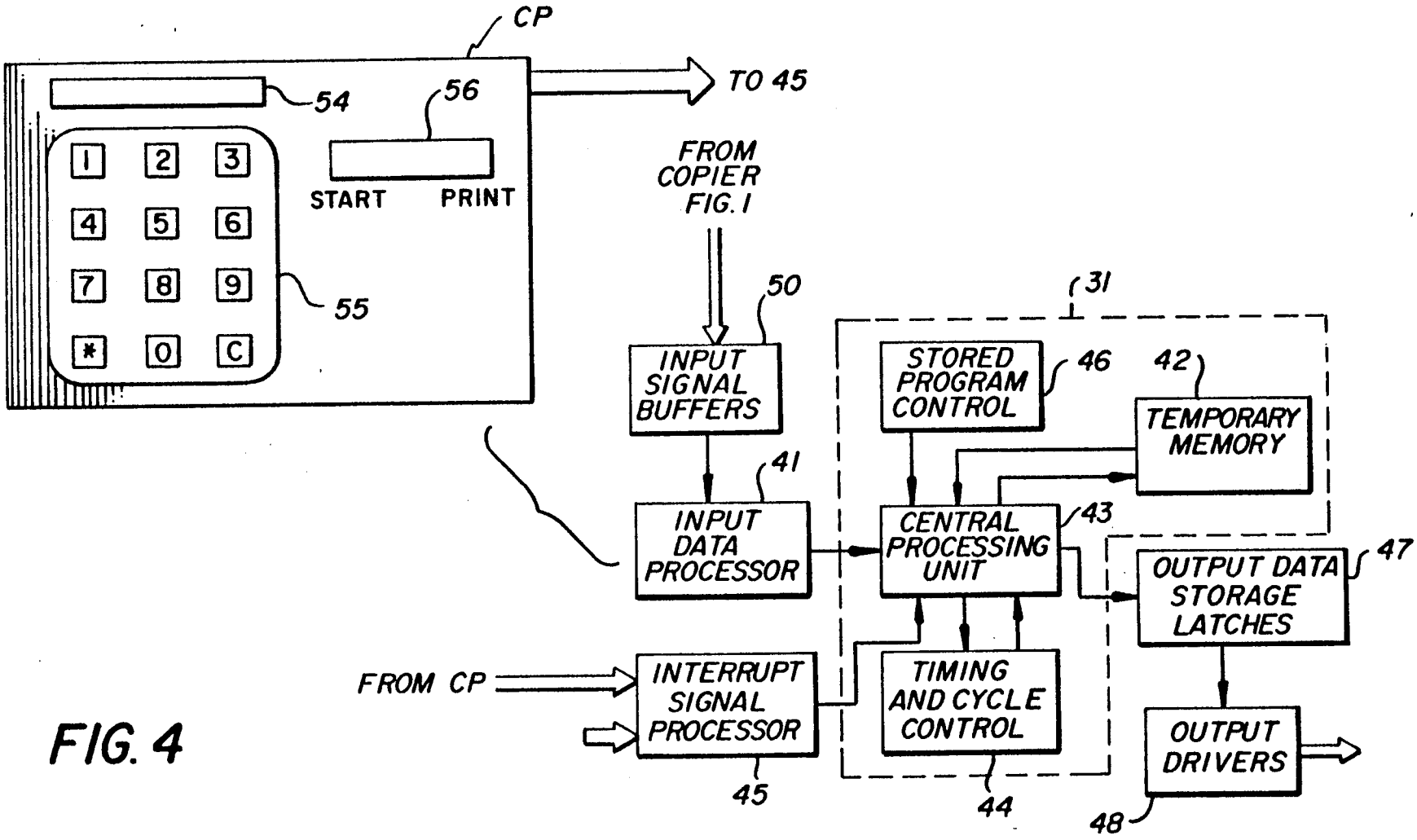
FIG. 4 is a block diagram of the controls for the apparatus of FIG. 1.
Figure 5:
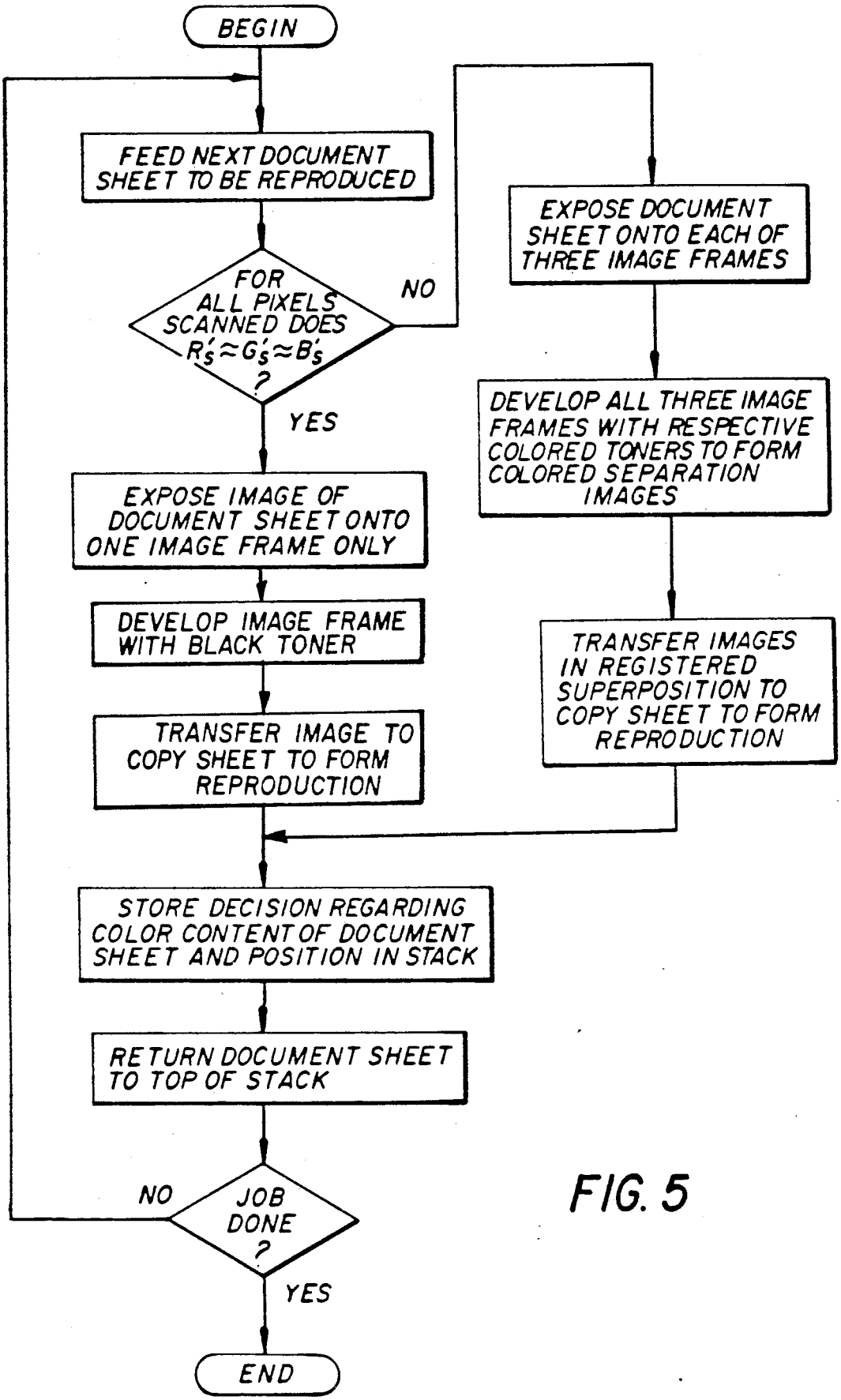
FIG. 5 is a flowchart illustrating operation of the apparatus in accordance with the method and apparatus of the invention.

With reference also now to FIG. 4, a block diagram of logic and control unit (LCU) 31 is shown which interfaces with the apparatus 10. The LCU 31 consists of temporary data storage memory 42, central processing unit 43, timing and cycle control unit 44, and stored program control 46. Data input and output is performed sequentially under program control. Input data are applied either through input signal buffers 50 to a input data processor 41 or to interrupt signal processor 45. The input signals are derived from various switches, sensors, and analog-to-digital converters. The output data and control signals are applied to storage latches 47 which provide inputs to suitable output drivers 48, directly coupled to leads. These leads are connected to the various work stations, mechanisms and controlled components associated with the apparatus.

A multicolored original document sheet D to be reproduced is located, image side down, on a transparent glass platen 20 supported by the copier frame. Exposure lamps 22, such as xenon flash tubes, are located beneath the platen 20 within the frame. The lamps flood the document sheet with light and a reflected image of the document sheet is transmitted via mirror 24, lens 26, and mirror 28 in focus to an area 30 lying in the plane of the web 12. The original document could, of course, be a transparency illuminated from the back side thereof. To reproduce an ordinary multicolored document in its original colors, the document sheet D is illuminated, for example, three times in succession to form three separate electrostatic latent image frames of the document. On successive illuminations a red filter 32R, a green filter 32G, or a blue filter 32B is inserted into the light path to form color separation images at the area 30. The timing of the flash of lamps 22 and the insertion of the colored filters are controlled by the LCU and related to the travel of the web 12 to expose adjacent, nonoverlapping areas of the web to the color separation images. One or more corona charging units, exemplified by corona charger 34, is located upstream of the exposure area 30, and applies a generally uniform primary electrostatic charge, of say negative polarity, to the web 12 as it passes the charge and before it enters the exposure area. A programmable power supply may be provided to selectively apply to each image frame a predetermined generally uniform electrostatic primary charge level Vo suitable for developing the particular color toner used to develop that image frame. The photoconductive properties of the web cause the primary charge in the exposed areas of the web to be discharged in that portion struck by the exposure light. This forms latent imagewise charge patterns on the web in the exposed areas corresponding to the respective color separation images. Travel of the web then brings the areas bearing the latent images into a development area 36. The development area has a plurality of magnetic brush development stations, corresponding to the number of formed color separation images, in juxtaposition to, but spaced from, the travel path of the web. Magnetic brush development stations are well known; for example, see U.S. Pat. No. 4,473,029 to Fritz et al and U.S. Pat. No. 4,546,060 to Miskinis et al. When the color separation images are red, green, blue three development stations are used respectively containing complementary colored toner particles, i.e., cyan particles in station 36C, magenta particles in station 36M and yellow particles in station 36Y. A fourth station containing black particles in station 36B is also provided and will be used for black only reproductions although it is known to also use the black station for reproduction of skeletal black images; see U.S. Pat. No. 4,791,450 in this regard. The toner particles are agitated in the respective developer stations to exhibit a triboelectric charge of opposite polarity to the latent imagewise charge pattern. Backup rollers 38C, 38M, 38Y, and 38B, located on the opposite side of web 12 from the development area, are associated with respective developer stations 36C, 36M, 36Y and 36B. Actuators 40C, 40M, 40Y and 40B selectively move respective backup rollers into contact with the web 12 to deflect the web from its travel path into operative engagement with respective magnetic brushes. The charged toner particles of the engaged magnetic brush are attracted to the oppositely charged latent imagewise pattern to develop the pattern.

The logic and control unit 31 selectively activates the actuators in relation to the passage of the image areas containing corresponding latent color separation images through the development area 36. That is, as the area containing the latent red color separation image reaches the development station 36C, actuator 40C moves the backup roller 38C to deflect the web so that the latent charge image is developed by attracting cyan toner particles from the station 36C. As soon as the image area leaves the effective development area of the station 36C, the actuator 40C returns the backup roller 38C to its nondeflecting position. Thus, as the areas containing the green and blue color separation images pass the developer station 36C, no development takes place. A similar cycle is accomplished by the logic and control unit 31 for the developer stations 36M, 36Y and 36B. In this manner, the red latent color separation image is developed only with cyan toner particles, the green latent color separation image is developed only with magenta toner particles, the blue latent color separation image is developed only with yellow toner particles.

The developed color separation images must be transferred to a receiver sheet in accurately registered superimposed relation to form a full color reproduction of the original document. Apparatus for providing such registered transfer are known, for example one of which is fully described in U.S. Pat. No. 4,477,176, issued Oct. 16, 1984 in the name of Matthew J. Russel the contents of which are incorporated herein by this reference. Briefly, this is accomplished by feeding a receiver sheet S from a supply stack stored in hopper 27 in synchronism with movement of the first image sector so that the copy sheet engages the web and is registered by mechanism 80 with the first image frame. A transfer roller 68 includes a compliant insulating surface thereon and is biased to a potential suitable for transfer of the developed image on the first image sector to the copy sheet S and to tack copy sheet S to roller 68. Roller 68 is driven by a stepper motor 19 which receives actuating signals from the LCU 31.

Roller 68 may also be a biased vacuum roller or a roller with sheet clamping mechanisms to clamp the sheet to it.

Continued movement of web 12 and synchronized rotation of roller 68 brings the lead edge of copy sheets back into transferable relationship with the web as he lead edge of the next toner image arrives at roller 68. At this point, sheet S remains tacked to roller 68 and the second toner image is transferred in superimposed registration with the first toner image on sheet S. The process is repeated until toner images on each of the first two images sectors have been transferred to the same surface of sheet S and the leading edge of copy sheet has been brought back into transferable relationship with the third toner image on the web. When the lead edge of copy sheet S is brought back into transferable relationship with web 12 for the last time, the bias on roller 68 is reversed to repel sheet S away from roller 68 back into contact with web 12. Copy sheet S will be carried by web 12 so that the copy sheet is in registration with the image on the third image sector. This image is transferred to the copy sheet by transfer charger 25. The copy sheet is separated from the web and conveyed by vacuum transport 60 or an air transport to roller fuser 62 where the transferred images are then fixed or fused onto the sheet. The sheet is then delivered to exit hopper 64 or an accessory finishing unit 69. While the image is being fixed to the receiver sheet, the web 12 continues to travel about its path and proceeds through a cleaning area 66.

To facilitate toner removal from the web, a corona charging station 70 and a rear erase lamp 71 may be located upstream of the cleaning unit 66 to neutralize any charge remaining on the web and thus reduce the adherence forces of the toner to the web.

Figure 2:
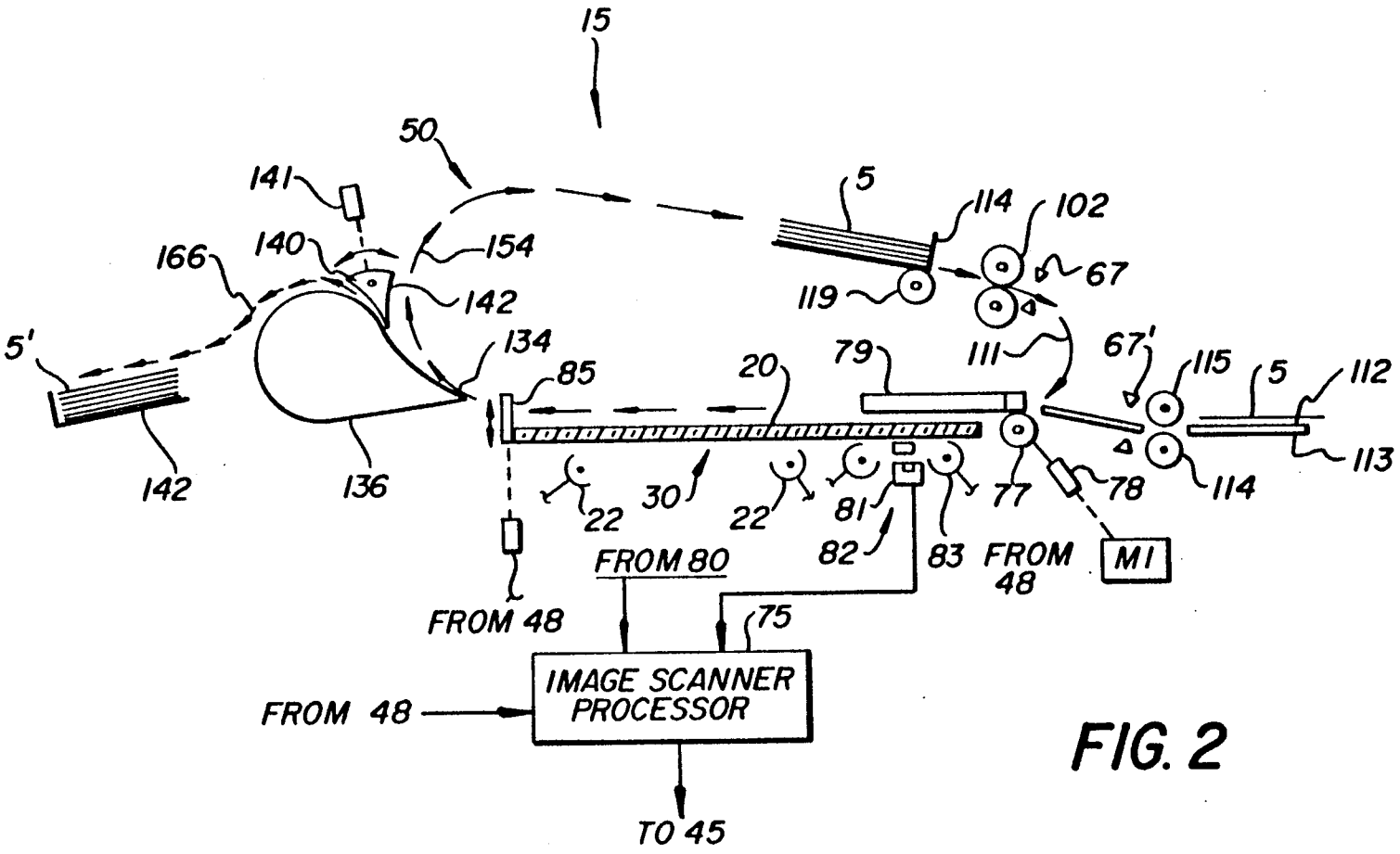
FIG. 2 is a close-up view of a recirculating feeder of the apparatus shown in FIG. 1.

With reference now to FIG. 2, a document sheet to be copied may be fed from a tray 114 forming part of a recirculating feeder 15 or from a document positioner 112. The tray 114 supports a stack of document sheets 5 to be fed to the exposure platen 20. In response to generation of a start signal initiated by pressing button 56, a copying operation is commenced by feeding a document sheet from the bottom of the stack by driving roller 119. A pair of feed rolls 102 then drives the sheet along the turning guide 111 into a nip formed between a metering roller 77 and a backup plate 79.

Figure 3:
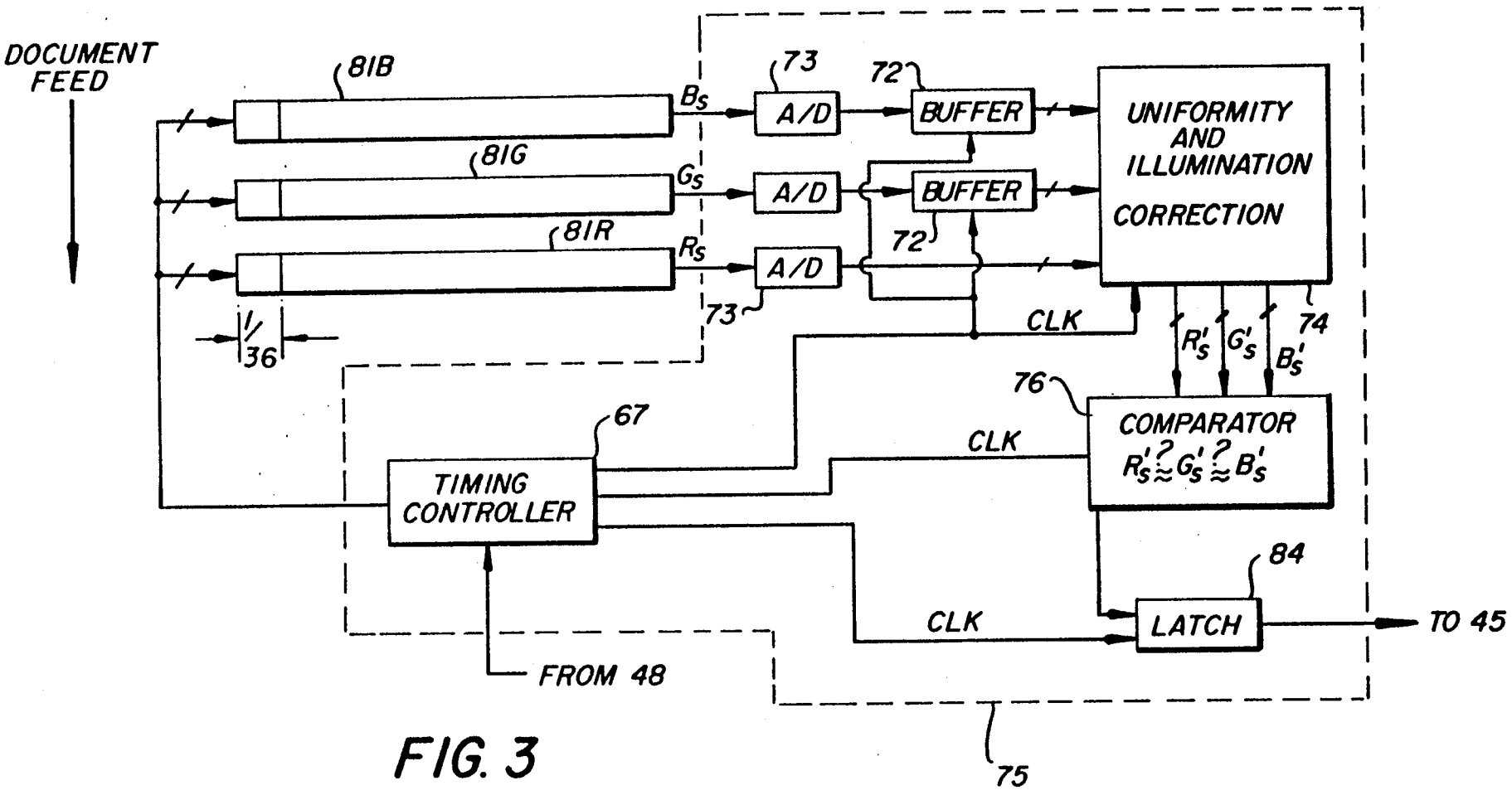
FIG. 3 is a sketch of a sensor for sensing the color content of documents.

The document sheet metering roller 77 is driven to accept the document sheet and advance the document sheet toward the exposure platen 20. The copier logic is also arranged to allow the operator to use the keyboard 55 to input the number of copies and other exposure data which is displayed in display 54. As the document sheet 5 is driven towards the platen, a document scanner unit 82 is provided that includes a pair of narrow aperture lamps 83 that directs a narrow beam of light onto the document. The document sheet is driven by roller 77 between the glass platen 20 and backing plate 79. The image content of the document sheet is sensed by image scanner 81 having rows of CCD's photodiodes or other light sensors arranged transverse to the direction of movement of the document. A Selfoc lens (trademark of Nippon Sheet Glass Company, Limited) may be used to focus the image of the illuminated area on a row of sensors. The sensors 81 (FIG. 3) are arranged linearly across the transverse direction of the document sheet to scan the entire sheet as it is transported onto transparent glass platen 20.

The document sheet is scanned line by line by the scanner 82. The scanner includes 3 rows of say CCD's, each row suitably filtered so one row, 81R, senses the red content of the image, another row, 81G, senses the green content of the image and a third row, 81B, senses the blue content of the image. Associated with the scanner drive roller 77 is an encoder 78 providing signals indicating line by line movement of the document. The area sensed by each CCD is relatively large 1/36 inch so that documents recorded in process black having some misregistration in color will still be detected by the sensors as black or grey rather than one of the constituent colors used to form that process black document. Signals from the sensors are sent to an image scanner processor 75. In the processor the signals $B_s$, $G_s$, and $R_s$, for each sensed pixel need to be first balanced in correction unit 74 to compensate for the "color" of the light output of lamps 83 as well as the characteristics for each light sensor element. In addition, since any pixel is first sensed by the sensors in row 81B, then 81G and lastly by those in row 81R there is a need to delay or store the signals sensed by blue and green sensors in buffers 72. At this point, the analog signals have been converted to their digital equivalents by A/D converters 73. The compensated signals (indicated by a prime) for each pixel are then compared in comparator 76 to see if the red content, $R'_s$, is approximate to the green content, $G'_s$, and also approximate to the blue content, $B'_s$. If this criterion is met on a pixel by pixel basis for all the pixels on the document, the document is treated as a black and white document in which reproduction can be made using only one image frame and developing same with black toner. Quantitatively, the criterion for each pixel on a document sheet could be: is $R'_s(1+3\%) \geqq G'_s$, AND is $R'_s(1-3\%) \leqq G'_s$; if NO document sheet is colored original; if YES is $R'_s(1+3\%) \geqq B'_s$, AND is $R'_s(1-3\%) \leqq B'_s$; if NO document sheet is colored original, if YES pixel is a black, gray or white (color neutral) pixel and the next pixel on the document sheet is investigated and so forth to see if they to meet the criterion. The quantitative criterion may also be adjustable by the operator in accordance with the type of document in the stock. For example, if some of the document sheets in a stack of originals are from, for example, computer aided drafting and include fine colored lines the use of a narrow range for testing for neutrality is desirable and the 3% quantization test recited above may be satisfactory. However, where the document sheet originals comprise a mix of black-only document sheets, document sheets with solid colored areas and/or colored halftones or colored continuous toned areas then a 10% quantization factor may be used which will detect misregistered process color blacks and reproduce same using black only toner. The operator may input the factor to be used using the keyboard and thereby adjust the LCU's test for determining color neutrality of a pixel. Still other tests for determining the color neutrality of a pixel may use the averaging of adjacent non-neutral pixels. If the criterion is not met, a latch 84 will be set providing an interrupt signal to the LCU through interrupt signal processor 45. The image scanner processor 75 is in turn controlled by signals from the LCU that are input to a timing controller 67 that provides the various signals for intiating and continuing operation of the scanner unit and processor 75. If the comparison criterion is not met, this implies there is some color to the image and it is treated as a colored original and reproduction is made using the three-color stations and suitable exposures using the various filters as decribed above to form the color separation images. The decision of document type is stored by the LCU in temporary memory 42 in addition with the documents position in the stack of documents in tray 114. Thus, if multiple copies of the document are desired, it is only necessary to scan each document once. On subsequent passes of the document to the platen for making additional copies requested, the LCU notes the position of the document being fed from the stack and employs the stored information concerning document type to control the exposure of the document using the appropriate number of image frames, filters and development stations.

The document is stopped by a stop 85 provided at the edge of the platen, which positions the document sheet so as to be in register with image frames on the photoconductive web 12 during an exposure.

As may be noted in FIG. 2, the document sheet feeding apparatus includes a recirculating feeder 15 and document positioner 112 for feeding the document into the document scanner unit 82 to the exposure platen 20. In one mode of operation of the apparatus 10, the document sheet 5 of a multisheet document are positioned in the tray 114 with the information to be copied facing upwardly, with the document sheets in their normal order, and with the topmost sheet being the first sheet of the document. A rotatable solenoid 141 which is connected to a sheet diverter 140 is energized in response to a signal from the LCU and rotates the diverter clockwise to the position illustrated in FIG. 2. Thereafter, in response to a signal from the LCU, the lowermost document sheet is withdrawn from the bottom of the stack in the tray 114 by means of the feeder 119 and fed through the path shown, past the document scanner unit 82 and onto the exposure platen 20. Block or registration gate 85 stops and registers the document sheet at the exposure platen. After a document sheet is illuminated by platen exposure lamps 90, 92, the block is withdrawn from the path of travel and the document sheet is then driven from the platen in the direction indicated by the arrows 134, 154 back onto the top of the stack of document sheets in the tray 114. This cycle continues until the required number of collated sets of copies has been made, as determined by a set counter (not shown) in the LCU.

FIG. 2 also illustrates the second mode of operation which uses the document positioner 112. When the document sheets are to be copied by means of the document positioner 112, a document sheet is fed across tray 113, into the nip of rotating rollers 114, 115 which feed it to document metering roller 77. The metering roller is actuated to feed the document sheet past the document scanner unit 82 and deliver it to the platen where it is registered by the block 85. After one or more copies of the document sheets are made, the block is raised and the drive rollers (not shown) drive the document sheet from the platen along the path indicated by arrows 134, 166. In this second mode, the solenoid 141 is de-energized and sheet diverter 140 is rotated counterclockwise to a position guiding the document sheet along the path 166 and the document sheet is delivered to a tray 142. Although the operation of the document positioner has been specifically described in connection with copying of simplex original documents, it will be apparent that duplex documents can be copied by operating the apparatus as described in U.S. Pat. Nos. 4,176,945 and 4,451,137.

As noted above, during each of the two different feed modes, the original document sheet 5 is oriented, image side down, on transparent glass platen 20 that is supported by the copier frame. Exposure lamps 22, such as xenon flash tubes, are located beneath the platen 20 within the frame. The lamps flood the document sheet with light and a reflected image of the document sheet is transmitted via mirror 24, lens 26, and mirror 28 in focus to an area 30 representing one image frame lying in the plane of the web 12.

Where reproduction of pages in a book is also contemplated the scanner may be made to move relative to the platen to scan these pages.

Assuming the detected document is a black and white original, the document is exposed without use of a filter on one image frame and developed with black toner in station 36B and transferred to a copy sheet. Where a document is detected as having any color content, scanning of that document is terminated and the metering roller may be speeded up to advance the document more quickly to the platen to be in position for exposure. Upon leaving the metering roller, a signal is provided indicating that the document will soon be in a position for commencement of exposure.

The invention also contemplates those apparatus and methods employing transfer of an electrostatic image to a second member which is eventually developed and used in transferring the image to a copy sheet.

The invention further contemplates the use of a single row of CCD's wherein the CCD's are alternatively responsive to red, green and blue color content of the image on the document sheet. This would eliminate the need for delays as three CCD's would see each pixel simultaneously.

While the preferred embodiment is described with reference to relatively large CCD elements, conventional CCD's having higher density may be used and connected electronically to function as a larger CCD. Color video CCD's comprising an areal array may also be used. In still a further modification, various operation modes may be called up using the keyboard to override the use of the sensor so that all documents are reproduced in black or in one of the other colors or in all three process colors.

While the invention has been described with particular reference to preferred embodiments thereof, it will be understood that variations and modifications can be effected within the spirit and scope of the invention.

I claim:

1. Apparatus for making copy comprising:

an electrophotographic recording member;

means for electrostatically charging said recording member;

means for supporting a document sheet for exposure;

means for directing an optical image of the image on the document sheet upon the recording member to imagewise modulate the electrostatic charge;

means for sensing the color content of the image on the document sheet for distinguishing between a document sheet containing a colored original image and a document sheet containing only black original images on the document sheet and generating a signal in accordance with the type of document sheet sensed;

means for developing electrostatic images with differently colored toners including a black only toner;

means responsive to said signal for controlling the number of images of said document sheet imaged upon said recording member wherein when said signal indicates a document sheet containing a colored image, a plural number of images are recorded, and when said signal indicates a document sheet containing only black images, fewer images than said number are recorded;

means responsive to said signal for developing electrostatic images copied from document sheets containing colored images with differently colored toners and for developing electrostatic images copied from document sheets containing only black images with black toner; and means for transferring one or more developed images to a copy sheet.

2. The apparatus of claim 1 and wherein the sensing means comprises a plurality of sensors, each of which senses the pixel sizes of at least 1/36 of an inch.

3. The apparatus of claim 2 and including an exposure platen;

a tray supporting a stack of original document sheets;

means for feeding the document sheets seriatim to the platen for exposure;

means for storing signals representing position identification of the document sheet in the stack and identification of a document sheet as colored or black-only image content; and means responsive to said signal for controlling the number of recorded images of said document sheets used for making subsequent copies of said document sheets.

4. The apparatus of claim 3 and wherein the number of recorded images of a black-only original document sheet is one.

5. The apparatus of claim 1 and including an exposure platen;

a tray for supporting a stack of original document sheet;

means for feeding the document sheets seriatim to the platen for exposure;

means for storing signals representing position identification of the document sheet in the stack and identification of a document sheet as of colored or black-only image content; and means responsive to said signal for controlling the number of recorded images of said document sheets used for making subsequent copies of said document sheets.

6. The apparatus of claim 5 and wherein the number of exposures of a black-only original document sheet is one.

7. The apparatus of claim 1 and including means for recording color separation images of said document sheet on the recording member.

8. The apparatus of claim 7 and including means for flash exposing the separation images onto said recording member.

9. The apparatus of claim 8 and including an exposure platen;

a tray for supporting a stack of original document sheets;

means for feeding the document sheets seriatim to the platen for exposure;

means for storing signals representing position identification of the document sheet in the stack and identification of a document sheet as colored or black-only image content; and means responsive to said signal for controlling the number of recorded images of said document sheets used for making subsequent copies of said document sheets.

10. The apparatus of claim 9 and wherein the number of recorded images of a black-only original document sheet is one.

11. The apparatus of claim 10 and wherein the sensing means comprises a plurality of sensors, each of which senses the pixel sizes of at least 1/36 of an inch.

12. The apparatus of claim 7 and wherein the sensing means comprises a pluality of sensors, each of which senses the pixel sizes of at least 1/36 of an inch.

13. The invention according to claim 1 and including means for adjusting a criterion for determining the color neutrality of a pixel.

14. The invention according to claim 2 and including means for adjusting a criterion for determining the color neutrality of a pixel.

15. The invention according to claim 3 and including means for adjusting a criterion for determining the color neutrality of a pixel.

16. The invention according to claim 4 and including means for adjusting a criterion for determining the color neutrality of a pixel.

17. A method for making copy comprising:

electrostatically charging an electrostatic recording member;

modulating the electrostatic charge by optically projecting an image of a document sheet to be reproduced upon the recording member;

automatically sensing the color content of the image to be reproduced and generating a signal identifying the document as a black only original;

in response to said signal inhibiting the development of the member with colored toners;

developing an exposed image frame of said member with a black only toner; and transferring the developed image to a copy sheet.

18. The method of claim 17 and including the step of generating a different signal identifying the document as a colored original and in response to said different signal providing plural exposures of a document upon said recording member;

developing electrostatic images of said document sheet with differently colored toners and transferring the developed images in register to a copy sheet.

19. The method of claim 18 and wherein the images are color separation images.

20. The method of claim 17 and including the steps of storing signals relative to the position of the document sheet in a stack of originals and the determination of type of document as to containing a color or black-only image content and employing said signals during reproduction of subsequent copies of the document sheets to control number of exposures of each document sheet and the toners used to develop same.

* * * * *